United States Patent [19]

Baricos et al.

[11] Patent Number: 4,895,061

[45] Date of Patent: Jan. 23, 1990

[54] SHOULDER-BORNE WEAPON FOR USE AS ROCKET LAUNCHER

[75] Inventors: Jean Baricos, Ramonville St. Agne; Denis Dilhan, Auterive; Michel Castarede, Mauvezin, all of France

[73] Assignee: Etienne Lacroix Tous Artifices S.A., Muret, France

[21] Appl. No.: 295,913

[22] Filed: Jan. 11, 1989

[30] Foreign Application Priority Data

Jan. 12, 1988 [FR] France ..... 88 00286

[51] Int. Cl.[4] ..... F41F 3/04

[52] U.S. Cl. ..... 89/1.818; 89/1.814; 89/1.816; 89/1.817

[58] Field of Search ..... 89/1.818, 1.817, 1.816, 89/1.814, 1.806, 1.8, 1.819, 1.704, 1.705, 44.01

[56] References Cited

U.S. PATENT DOCUMENTS

| | | | |
|---|---|---|---|
| 2,363,675 | 11/1944 | Johnson | 89/1.3 |
| 3,004,475 | 10/1961 | Barr et al. | 89/1.814 |
| 3,256,777 | 6/1966 | Choate et al. | 89/1.817 |
| 3,398,640 | 8/1968 | Apotheloz et al. | 89/1.818 |
| 3,401,597 | 9/1968 | Compte et al. | 89/1.816 |
| 3,745,877 | 7/1973 | Dobson et al. | 89/1.814 |
| 3,750,529 | 8/1973 | Reed et al. | 89/1.816 |
| 4,038,902 | 8/1977 | Welsh | 89/1.807 |
| 4,426,910 | 1/1984 | Speer | 89/1.816 |
| 4,672,881 | 6/1987 | Betts et al. | 89/1.816 |

*Primary Examiner*—David H. Brown

[57] ABSTRACT

A shoulder-borne weapon for use as a rocket launcher is disclosed. To enable its use in an enclosed space with any complication or excess weight, and without imposing any appreciable recoil effect on the gunner, for all that, at least one weapon tube is guided in limited longitudinal, sliding motion with respect to a barrel comprising shoulder rest means, grip means and firing control means, and means are provided to exert force elastically on the weapon tube, frontwards with respect to a predetermined firing direction, so as to dampen the recoil motion of the weapon tube with respect to the barrel.

14 Claims, 5 Drawing Sheets

SHOULDER-BORNE WEAPON FOR USE AS ROCKET LAUNCHER

BACKGROUND OF THE INVENTION

1. Field of the Invention

The present invention concerns a shoulder-borne weapon for use as a rocket launcher, comprising at least one longitudinal weapon tube, and one barrel which is at least partially juxtaposed transversally with respect to the tube, comprising shoulder rest means, grip means and firing control means.

2. Description of the Prior Art

Conventionally, a rocket is a self-propelled munition which is most usually designed to reconcile the requirements of long range and high kinetic energy upon impact.

In the most commonly known way, rockets of this type are launched by means of shoulder-borne weapons of the type indicated in the introduction. In these shoulder-borne weapons, the weapon tube, which is solidly joined to the barrel, is open at both its transversal ends in order to reduce the recoil effect of the weapon when a rocket is launched. However, the transversal end of a weapon tube which is pointed to the rear, with respect to a determined longitudinal firing direction, suddenly lets a large quantity of hot gas escape when a rocket is launched. This makes it practically impossible to use a weapon of this type in an enclosed space.

In an attempt to overcome these drawbacks, it has also been proposed to use shoulder-borne weapons of the type indicated in the introduction, which however have been used to fire inert projectiles, namely projectiles without propellent, by means of a pyrotechnical ejection charge:

either by providing, at the transversal end of the weapon tube, which is pointed backwards with reference to a determined longitudinal firing direction, a movable chamber which, when a projectile is fired, dampens the recoil effect but lets through the gases resulting from the combustion of the pyrotechnical ejection charge, which is then reduced to restrict the gas emission; this approach has the drawback of not completely preventing the sudden emission of gases behind the weapon tube, namely inside an enclosed space when firing is done from inside such an enclosed space of this type. It also has the drawback of limited range of the weapon because the ejection charge is reduced;

or by providing, within the weapon, for a set of pistons or a bag which confines the combustion gases of the pyrotechnical charge and counter-masses, which are discharged simultaneously with the firing of a projectile, to reduce the recoil effect; this approach has the advantage of being entirely compatible with firing in an enclosed space, in preventing any release of gas outside the weapon, and in practically cancelling the recoil effect; however, this approach entails complication and high cost for the weapon, as well as an increase in mass which makes it necessary to reduce the mass of the other components of the weapon and the projectile in order to keep the mass of the entire unit compatible with firing from the shoulder.

An object of the present invention is to overcome these drawbacks, that is, to propose a shoulder-borne weapon for use as a rocket launcher which can be used in an enclosed space preventing any discharge of gas towards the inside of this enclosed space, and any ejection of counter-masses and which, at the same time, subjects the gunner to the minimum amount of discomfort caused by recoil when a rocket is launched.

SUMMARY OF THE INVENTION

To this effect, the invention proposes a shoulder-borne weapon, of the type indicated in the introduction, wherein the weapon tube is of a type comprising a closed transversal end, placed towards the rear with reference to a defined longitudinal firing direction, and wherein the weapon tube is connected to the barrel by means of connecting devices comprising:

means for guidance in a relative, longitudinal, sliding motion, mutual stop means restricting the longitudinal sliding motion of the weapon tube at least frontwards, with respect to said direction, in relation to the barrel, means for exerting longitudinal elastic force on the weapon tube frontwards with respect to said direction, in relation to the barrel.

It can be easily understood that the (permanent) closing of the transversal end of the tube pointed backwards prevents a sudden emission of gas from the weapon through this end when a rocket is launched. The gases can escape from the weapon tube only through its transversal end pointed frontwards, with reference to the defined firing direction, generally placed outside the enclosed space when the weapon is used in such an enclosed space, after the rocket has left the weapon tube. However, the gunner experiences an acceptable recoil effect when a rocket is launched owing through a damping effect brought into play by the elastic assembly of the weapon tube with the barrel.

In view of the fact that the weapon tube is movable with respect to the barrel, the use of electrical type firing control means is particularly appropriate, although other types are not ruled out.

According to an especially advantageous embodiment of a weapon according to the invention, the connecting means are capable of enabling the mounting and disassembly of the weapon tube with respect to the barrel. It is thus possible to mount, at choice, and on one and the same barrel, weapon tubes corresponding to different calibers and/or to have magazines comprising at least one weapon tube and the associated rocket ready for launching from within this weapon tube, to easily mount this loaded weapon tube on the barrel before making the launch and to then remove the empty weapon tube after the launch so as to replace it by at least one other weapon tube, also charged with the corresponding rocket.

For example, the means for guidance in relative, longitudinal sliding motion comprise longitudinal sliding channel means, arranged on the barrel, slide bar means, mounted to slide in the sliding channel means, complementary, detachable, locking elements respectively borne by the slide bar means and by the weapon tube. The positioning of at least one weapon tube, notably loaded with the corresponding rocket, on the barrel is particularly easy and swift if, in addition, the weapon includes means to exert elastic force on the slide bar means,, frontwards with reference to said direction, in relation to the sliding channel means, and if the mutual stop means include means to stop the slide bar means frontwards, with reference to said direction, in relation to the sliding channel means.

The weapon components integrated into the weapon tube, which may be discarded after being used only once, are reduced to a minimum, and the convenience and speed with which the weapon tube or a magazine is mounted on or disassembled from the barrel is increased if, according to a preferred mode of implementing the invention, the connecting means comprise a longitudinal sleeve solidly joined to the barrel, located in a rear zone of the barrel with reference to said direction and receiving the weapon tube in longitudinal sliding motion, and if the means exerting elastic force on the weapon tube frontwards with reference to said direction, in relation to the barrel, include a piston which is mounted so that it slides longitudinally in the sleeve and on which the weapon tube rests towards the rear, with reference to said direction, through said closed transversal end, means exerting elastic force on the piston frontwards with reference to said direction, in relation to the sleeve, and means to stop the piston frontwards with reference to said direction, in relation to the sleeve; when, as preferred, the firing control means are electrical, the piston and the weapon tube then advantageously have complementary electrical connection means for the firing control means, the connection means being in respective positions that face one another longitudinally.

Naturally, it is possible to envisage the making of a shoulder-borne weapon according to the invention with only one weapon tube, preferably mounted detachably, by appropriate connection means, for example of the type indicated above. Preferably, however, the weapon according to the invention has a plurality of longitudinal weapon tubes of said type, juxtaposed in a mutually transversal way and solidly joined to one another, connected to the barrel by said connecting means. The weapon tubes are distributed evenly and angularly around a longitudinal axis and the elastic force exerting means have a line of effect which substantially coincides with said axis, between the weapon tubes. Naturally, the rockets corresponding to the different tubes may then be launched simultaneously but, preferably, the firing control means have tube selecting means which can be used to fire the rockets one by one or in salvos so as to prevent excessively frequent reloading operations, namely the changing of weapon tubes in the case of interchangeable weapon tubes. The selection means are preferably automatic and sequential so as to make the use of the weapon particularly convenient.

For example, according to one embodiment, there is an even number of weapon tubes, distributed in groups of two weapon tubes which are mutually symmetrical with respect to said axis, and the tube selecting means consist of means for the selection of groups of two weapon tubes which are mutually symmetrical with respect to said axis. Thus, just like the reaction they cause in the elastic force exerting means, the stresses resulting from the thrust applied to the weapon tube by the simultaneously fired rockets show a mechanically very satisfactory resultant along the axis.

In a particularly efficient embodiment of the elastic force exerting means, in the case of a plurality of weapon tubes solidly joined to one another, arranged as indicated above, mounted interchangeably and resting on a piston subjected to elastic force as also indicated above, the weapon tubes together demarcate, along said axis, a longitudinal housing, the piston has, solidly joined along said axis a tubular extension frontwards, with respect to said direction, inside said housing, the sleeve bears, towards the rear of the piston, with reference to said direction, a solidly joined transversal back piece carrying a solidly joined rod that projects frontwards, with respect to said direction, along said axis, said rod crossing said tubular extension from one side to the other, and having a solidly joined transversal stop head within said housing, in front of said tubular extension with reference to said direction, and said tubular extension bears, solidly joined between said transversal back piece and said stop head, a collar mounted so that it slides longitudinally on the rod and respectively rests, frontwards and towards the rear, with reference to said direction, against said stop head and against a helical spring with longitudinal compression, which is housed between said rod and said tubular extension and itself rests on said back piece towards the rear, with reference to said direction; an approach of this type reconciles minimum space factor of the weapon with high efficiency in the guidance of the weapon tubes as well as in the exertion of elastic force on these weapon tubes in reaction to the thrust that they undergo when the rockets are launched; the guidance of the weapon tubes with respect to the barrel is even more efficient if, according to a preferred embodiment, said transversal back piece carries, solidly joined, around said rod and said spring, within said tubular extension, a longitudinal skirt for its guidance in the longitudinal sliding motion.

BRIEF DESCRIPTION OF THE DRAWINGS

Other features and advantages of the shoulder-borne weapon according to the invention will emerge from the following description, made with reference to a non-restrictive embodiment, as well as from the appended drawings which are an integral part of this description.

DESCRIPTION OF PREFERRED EMBODIMENTS

Figure 1:
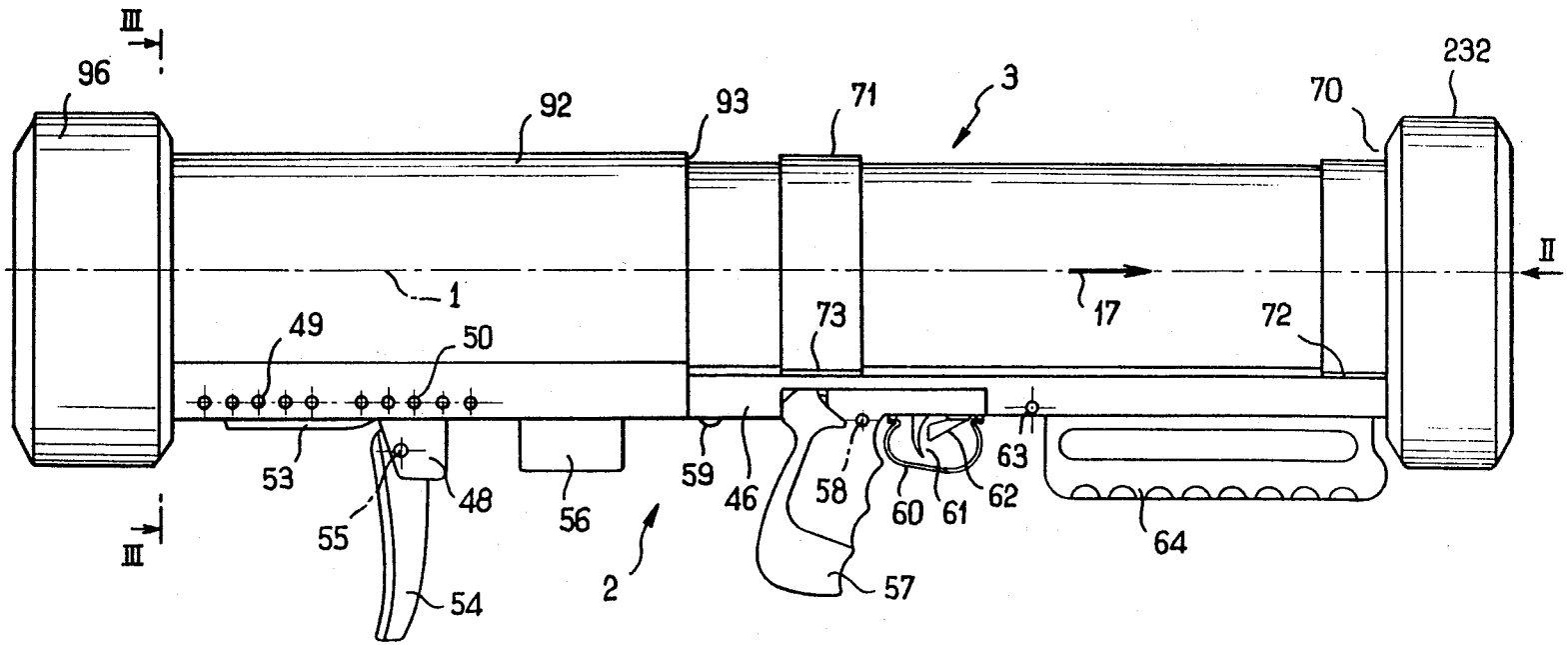
FIG. 1 shows a view of a weapon according to the invention, provided with transversal end shielding hoods, in firing position, in a side view.
Figure 3:
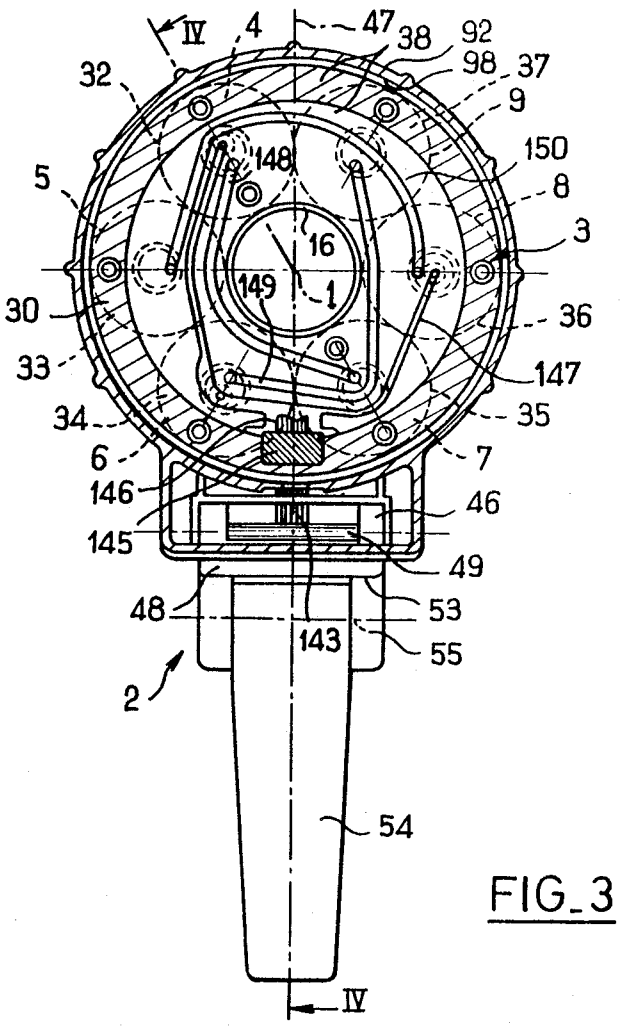
FIGS. 2 and 3 show views of this same weapon without shielding hoods, respectively seen in a longitudinal direction identified by an arrow II in FIG. 1 and in a sectional view along a transversal plane marked III—III in FIGS. 1 and 4.

In all these figures, reference 1 designates a longitudinal axis which shall serve as a reference of longitudinal direction and of transversality in the rest of the description, reference 2 designates the longitudinal barrel of the weapon and reference 3 designates a magazine which can be removed from the barrel 2, and groups together six identical, longitudinal weapon tubes, 4, 5, 6, 7, 8, 9, with respective longitudinal axes 10, 11, 12, 13, 14, 15 that are evenly and angularly distributed around the axis 1 and are equidistant from this axis. These weapon tubes 4, 5, 6, 7, 8, 9 are arranged around a central tube 16 which is also longitudinal, and has, for its axis, the axis 1, in a relationship of mutual contact and mutual solid connection achieved by any appropriate means, the choice of which is within the scope of the normal abilities of those skilled in the art. Each of the tubes, 4, 5, 6, 7, 8, 9, 16, the diameters of which are identical, has an open front end 18, 19, 20, 21, 22, 23, 24, located towards the front with reference to a determined longitudinal direction 17, opposite to the direction of the arrow II. This open front end 18 is shielded by a cap, 25, 26, 27, 28, 29, 30, 31 respectively, which is simply fitted on and can be easily removed longitudinally, and a front end shielding hood 232 which is common to all the tubes 4, 5, 6, 7, 8, 9, 16 and practically presents no obstacle to being pierced by a rocket. It will be noted that the respective front ends 18, 19, 20, 21, 22, 23, 24 are placed transversally to the axis 1 at one and the same longitudinal level. Towards the rear, with reference to the direction 17, the weapon tubes 4, 5, 6, 7, 8, 9 have transversal ends, 32, 33, 34, 35, 36, 37 respectively, at one and the same longitudinal level, respective transversal ends 32, 33, 34, 35, 36, 37 which are permanently closed by a transversal back piece having a flat, ring-shaped transversal plate 38, which is common to all the weapon tubes 4, 5, 6, 7, 8, 9 and is complemented, within each of the tubes, by a respective solidly joined plug such as 39 (for tube 4 for example, each of the weapon tubes 4, 5, 6, 7, 8, 9 being made identically). On the contrary, the central tube 16, which is not a weapon tube, is open towards the rear with reference to the direction 17 and is bordered by the ring-shaped plate 38 which extends radially towards the outside of this tube 16 with reference to the axis 1, and extends it towards the rear as shall be described further below.

Inside each of the weapon tubes 4, 5, 6, 7, 8, 9, a transversal pin which can be sheared longitudinally, namely a pin such as 41 (in the example of the tube 4, an identical assembly being chosen for each of the weapon tubes 4, 5, 6, 7, 8, 9) retains a rocket such as 40 (in the example of the weapon tube 4). The rocket such as 40, of a structure known per se, has a tail unit such as 42 which is isolated from the rear end plug such as 39 of the weapon tube such as 4 by a tubular piston such as 200 mounted in a free, longitudinal sliding position in this weapon tube such as 4. Each piston such as 200 rests, towards the rear, against the corresponding plug such as 39 and, towards the front, against the rocket such as 40 itself, at the level of a pyrotechnical motor such as 45 of this rocket. This piston such as 200 demarcates, facing the plug such as 39, an unoccupied volume such as 43 for transmission of fire and expansion of gas between, on the one hand, a pyrotechnical ejection charge such as 44, provided in the respectively corresponding plug such as 39 and, on the other hand, the pyrotechnical motor such as 45 of the rocket such as 40. The piston 200, to which each of the pistons thus housed in the different weapon tubes is identical, has:

a rear tubular wall 201 which is bounded, respectively towards and away from the axis 10 of the tube 4, by an internal peripheral face 202 and by an external peripheral face 203, both having a cylindrical shape of rotation on the axis 10, the external peripheral face 203 having a diameter which is substantially equal to the inner diameter of the weapon tube 4 so as to set up a mutual guiding contact in the relative longitudinal sliding motion, and the two faces 202 and 203 being mutually joined towards the rear by a transversal, flat, ring-shaped face 204 which is in contact, towards the rear, with the plug 39;

a transversal ring-shaped wall 205, bounded respectively towards the rear and towards the front by transversal, by flat ring-shaped faces 206 and 207 which are respectively connected, in a direction away from the axis 4, to the faces 202 and 203 of the wall 201, the front transversal face 207 being placed immediately to the rear of the tail unit 42 of the rocket 40, a front, tubular wall 208, bounded, respectively towards and away from the axis 10 of the tube 4, by an inner peripheral face 209 and an outer peripheral face 210, both cylindrical with a shape of rotation on the axis 10, with respective diameters that are smaller than the diameter of the face 202 and the diameter of the face 203 respectively, the diameter of the face 210 being furthermore such that the wall 208 can be housed within the tail unit 42 without hindering a relative longitudinal sliding motion and the two faces 209 and 210 being joined, towards the rear, respectively to the face 206 and the face 207 of the wall 205;

a transversal, ring-shaped wall 211 bounded, respectively towards the rear and towards the front, by transversal, flat, ring-shaped faces 212 and 213 which are respectively joined, in a direction away from the axis 4, to the faces 209 and 210 of the wall 208, the front transversal face 213 being placed in contact with the motor 45 of the rocket 10, inside the tail unit 42 of this rocket 10, and the two faces 212 and 213 being joined, towards the axis 10, to a bore 214 for the transmission of fire between the volume 43, internal to the walls 201 and 208, and the motor 45 of the rocket, said bore 214 crossing the wall 211 on either side along the axis 10 and having a cylindrical shape of rotation on this axis 10 with a smaller diameter than the respective diameters of the inner peripheral faces 202 and 209 of the tubular walls 201 and 208.

A magazine 3 of this type, for which each weapon tube 4, 5, 6, 7, 8, 9 contains a respective rocket such as 40, retained in the immediate vicinity of the respectively corresponding rear end plug such as 39, by means of a respective pin capable of being sheared, such as 41, can be mounted in a single operation, as an entire unit, on the barrel 2 which will now be described, and can then be dismantled as an entire unit after the various rockets are launched.

Figure 4A:
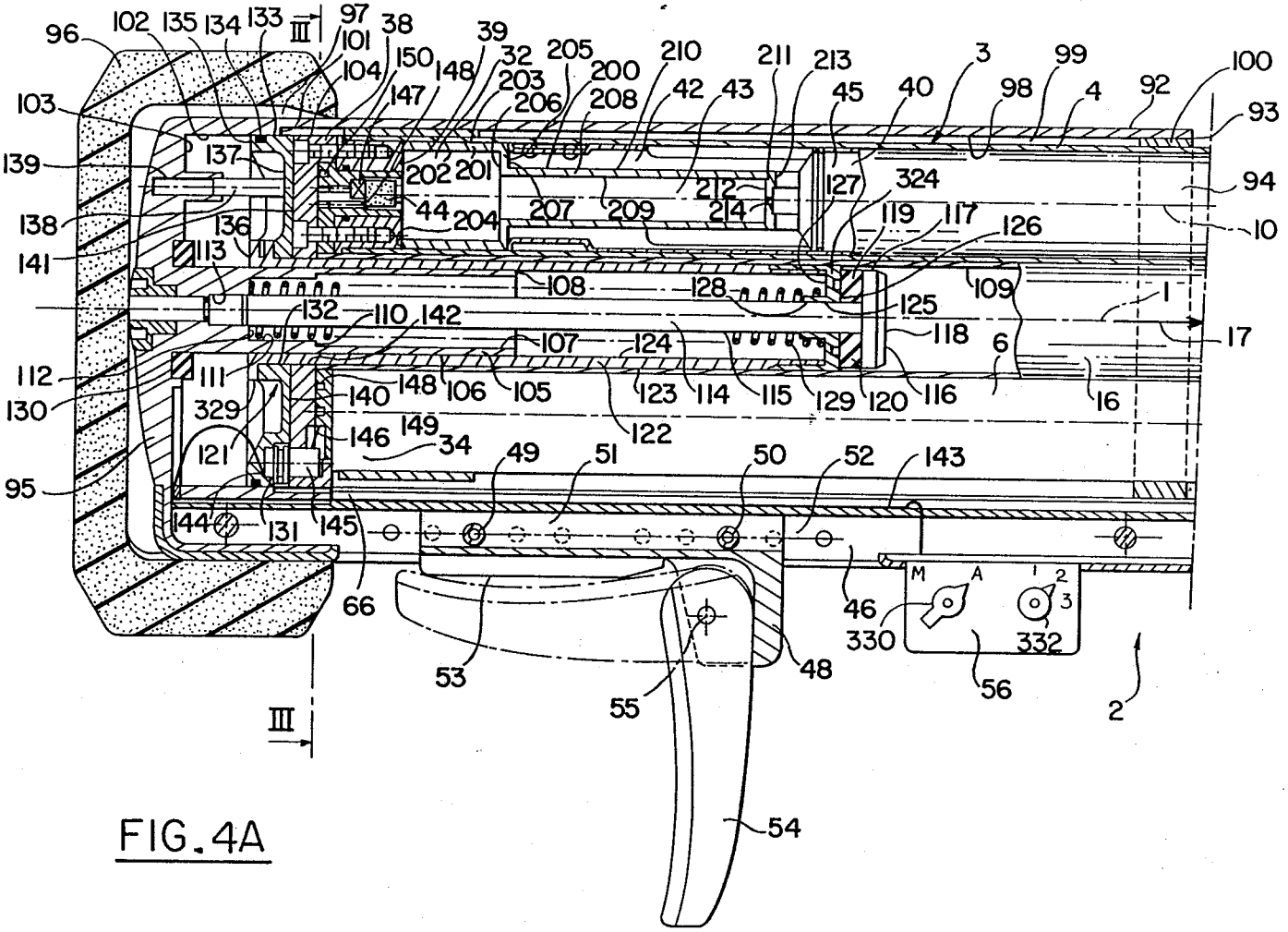
FIGS. 4A and 4B, which complement each other, show the weapon in its state illustrated in FIG. 1, in a section along two longitudinal half planes identified in IV—IV in FIG. 3.
Figure 4B:
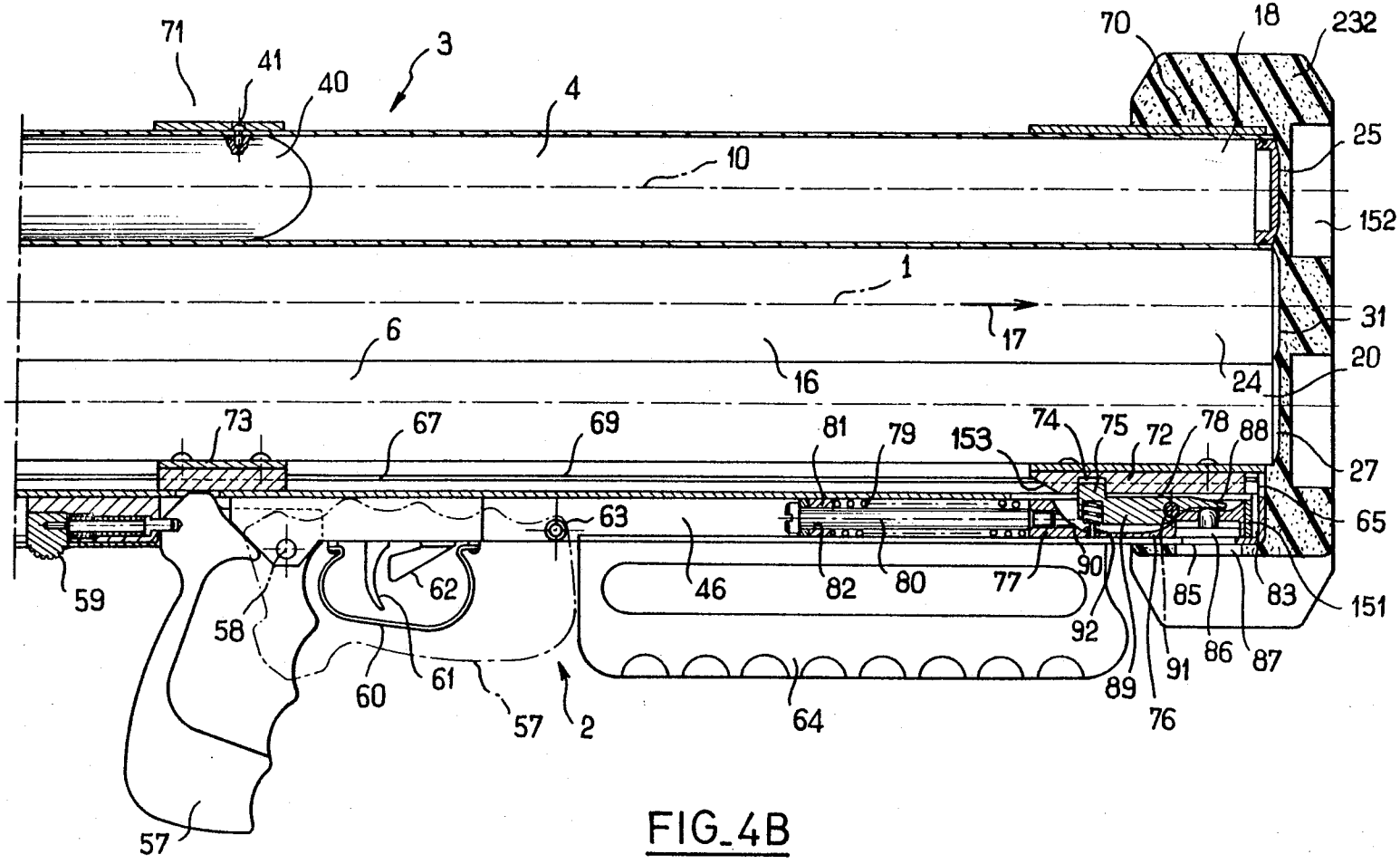

To this effect, the barrel 2, described in the assembled state with the magazine 3 as illustrated, has its own rigid, longitudinal, supporting frame 46 rigidly bearing a number of elements opposite to the magazine 3, along one and the same longitudinal plane 47 including the axis 1, constituting a longitudinal plane of symmetry for the barrel 2 and the magazine 3 considered as a whole and defining that part of the plane of FIGS. 4A and 4B located beneath the axis 1. The above-mentioned elements, succeeding one another from rear to front with reference to the direction 17, are as follows:

at a longitudinal level corresponding approximately to that of the tail units such as 42 of the rockets such as 40 inside the weapon tubes 4, 5, 6, 7, 8, 9, a shoulder rest support 48 wedged into holes 49, 50 of the supporting frame 46, chosen from among respective groups 51, 52 of holes which are mutually offset longitudinally to permit an adjustment of the longitudinal position of the support 48 on the supporting frame 46, said support 48 having a longitudinal plate 53 in its rear zone for resting on a gunner's shoulder and a transversal shoulder rest 54, in the front zone, which can be folded backwards from the support 48 on an axis 55 perpendicular to the plane 47;

a box 56 enclosing components of electrical firing control means, notably an electric battery and an electronic distributor for the firing order of the rockets such as 40, corresponding to the different weapon tubes, in a sequence which shall be described further below, said box 56 being rigidly and solidly joined to the supporting frame 46;

a transversal grip 57 which can be turned down frontwards by pivoting on an axis 58 perpendicular to the plane 47 with respect to the supporting frame 46, the grip 57 being held in the position of use by means of a bolt 59 which can be actuated by hand;

a trigger guard 60 protecting a trigger 61 and an electrical switch 62 for the firing control means, having also the components included in the casing 56; the set formed by the trigger guard 60, the trigger 61 and the switch 62 is covered by the grip 57 when the latter is turned up frontwards and wedged in a detachable way into the supporting frame 46, at 63, as shown schematically with dots and dashes in FIG. 4B;

a fixed longitudinal grip 64.

These elements are known to those skilled in the art or can be easily conceived by them and shall not be further described, except for the function of the components contained in the box 56.

Figure 2:
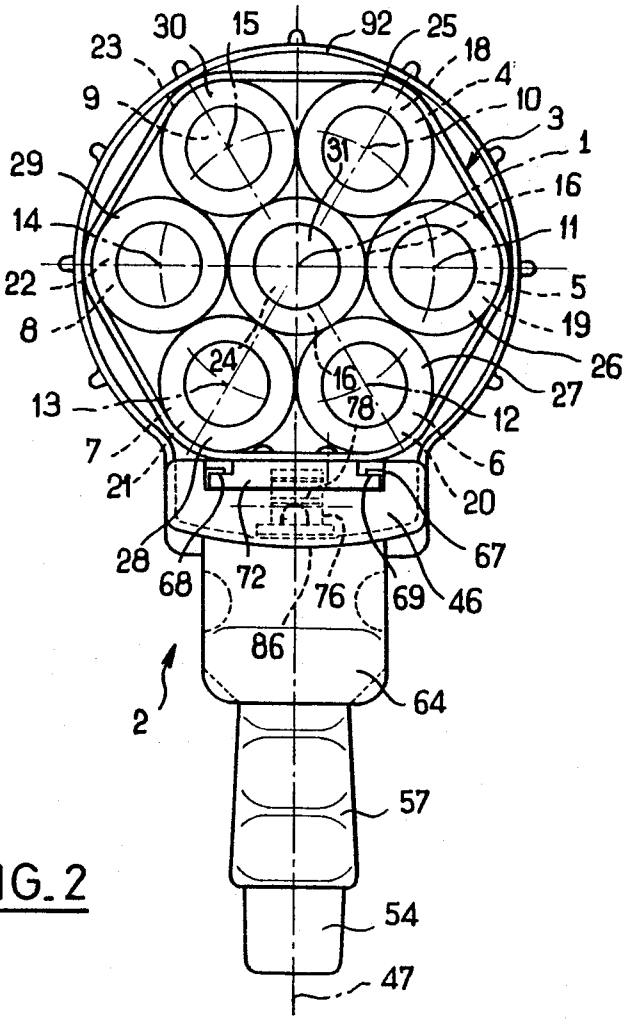

Facing the magazine 3, and as can be seen more particularly in FIG. 2, the supporting frame 46 has, at one front end 65 which longitudinally penetrates the hood 232 up to a rear end zone 66 located behind the support 48, a longitudinal sliding channel 67 having, facing the magazine 3, two longitudinal shoulders 68 and 69 pointed towards each other and symmetrical to each other with respect to the plane 47, so as to define a narrowing of the sliding channel 67 in the zones of this sliding channel which are closest to the magazine 3. In a complementary way, respectively in a front end zone 70 of the magazine, corresponding to the front ends 18, 19, 20, 21, 22, 23, 24 of the tubes 4, 5, 6, 7, 8, 9, 16, and in an intermediate zone 71 at approximately mid-length on the magazine 3, i.e. at mid-length on its tubes, the magazine 3 has two solidly joined slide bars 72, 73, each of which has a T-shaped cross section, which is symmetrical with the plane 47 and is such that each of the slide bars 72, 73 is held within the sliding channel 67 and, more precisely, is held by its shoulders 68 and 69 with the possibility of relative longitudinal sliding motion with any other possibility of relative motion being excluded.

While the slide bar 73 exclusively fulfils a function of guiding the magazine 3 in the longitudinal sliding motion with respect to the supporting frame 46, in working together with the slide 67, the slide bar 72 further provides for locking the magazine 3 with respect to the supporting frame 46, preserving this possibility of relative sliding.

To this effect, the slide bar 72 has, inside the sliding channel 67, away from the axis 1 in a radial direction, a blind hole 74 in which there is engaged, radially towards the axis 1, a pawl 75 of another slide bar 76 which is itself guided so that it slides longitudinally inside the supporting frame 46, by a longitudinal sliding channel 77 which is transversally juxtaposed with the sliding channel 67, away from the axis 1 in a radial direction, with only the pawl 75 of the slide bar 76 projecting into the sliding channel 67 towards the axis 1; the sliding channel 77 may be formed, for example, by a tubular section of the supporting frame 76 having, towards the inside of the slide 67, along the plane 47, a longitudinal opening 78 for the passage of the pawl 75.

Inside the sliding channel 77, the slide bar 76 is elastically subjected to frontward stress by a longitudinal, helical spring 79 which acts, around a longitudinal rod 80 that extends the slide bar 76 towards the rear, between this slide bar 76 on the one hand, and a transversal partition wall 81 closing the sliding channel 77 towards the rear on the other hand, said wall 81 being pierced with a longitudinal bore 82 in which the rod 80 is guided in the longitudinal sliding motion. Thus, while permitting the slide bar 76 to slide backwards inside the sliding channel 77, with respect to the supporting frame 46, the spring 79 tends, elastically, to hold the slide bar 76 in a limit forward position, illustrated in FIG. 4B, wherein, towards the front, this slide bar 76 abuts a transversal wall 83 enclosing the sliding channel 77 towards the front, at the front end 65 of the supporting frame 46 preferably by means of a transversal plate 151 made of an elastically compressible material such as a synthetic rubber. In this position, the slide bar 76 has, facing a transversal hole 85 of the supporting frame 76, located immediately in front of the longitudinal grip 64, on the same side of the supporting frame 46 as this grip 64, facing a hole 87 of the hood 232, a push button 86 guided so that it slides radially, with reference to the axis 1, within the slide bar 76 in resting, towards the axis 1, on a front zone 88 of a longitudinal lever 89 solidly bearing the pawl 75 in a rear zone. The lever 88, housed in a recess 90 of the slide bar 76, is mounted so that it pivots with respect to this slide bar on an axis 91 perpendicular to the plane 47, between its zone 88 working together with the push button 86 and its zone bearing the pawl 75. At this pawl 75, the lever 89 receives an elastic thrust, towards the axis 1, from a helical spring 92 interposed at this level, between the lever 89 and the slide bar 76, and acting between said lever 89 and said slide bar 76 along a radial direction with respect to the axis 1, so as to pull the pawl 75 towards the axis 1. The pawl 75 thus gets engaged in the blind hole 74 of the slide bar 72. However, a pressure of the finger on the push button 86, towards the axis 1, over compensates for the effect of the spring 92 so as to make the lever 89 tilt and thus withdraw the pawl 75 from the blind hole 74. It can be understood that the slide bar 72 is then free to slide with respect to the slide bar 76 to enable assembly or dismantling of the magazine 3 with respect to the barrel 2 by the sliding of the slide bars 72 and 73 in the sliding channel 67, whereas the absence of any force deliberately exerted on the push button 86, enabling the pawl 75 to be engaged in the blind hole 74 under the effect of the spring 92, makes the slide bars 72 and 76 join together in the longitudinal sliding motion, respectively in the sliding channel 67 and in the sliding channel 77 with respect to the barrel 2, so much so that the limits imposed, respectively towards the front and towards the rear, on the sliding of the slide bar 76 in the sliding channel 77, by the walls 81 and 83 of this sliding channel 77, are also imposed on the magazine 3 with respect to the barrel 2 considered in its entirety.

Behind the slide bar 73, the magazine 3 is engaged, with the possibility of a relative, longitudinal sliding motion, in a longitudinal sleeve 92 with a general shape of rotation on the axis 1, said sleeve 92 being borne, in a solidly joined way, by the supporting frame 46 in its rear half with reference to the direction 17.

Towards the front, with reference to the direction 17, the sleeve 92 has a transversal edge 93 which is located immediately behind the bolt 59 and demarcates a front opening 94 through which the magazine 3 penetrates the sleeve 92. Towards the rear, this sleeve 92 is closed by a rear back piece 95 which is rigid like the sleeve 92 itself and is solidly joined to it. At the level of this back piece 95, as well as in its immediate vicinity, the sleeve 92 has an end shielding hood 96 advantageously made of an elastically compressible material such as a spongy, synthetic rubber which may also form the previously described hood 232. The back piece 95 of the sleeve 92 is thus located behind the rear end 66 of the sliding channel 67. The hood 96 extends frontwards approximately up to the longitudinal level of the rear end 66 of the sliding channel 67 while, however, remaining behind the rear limit of the support 48 but in its vicinity.

Inside, towards the axis 1 of the edge 93 up to a zone 97 close to the back piece 95, the sleeve 92 has an inner peripheral face 98 with a general cylindrical shape of rotation on the axis 1 and with a diameter such that there remains, throughout, a peripheral clearance 99 between the magazine 3 and this face 98. This clearance 99 is advantageously filled locally, especially in the immediate vicinity of the edge 93 of the sleeve 92, by a transversal ring 100 made of a material selected so as to provide dust-proofing between the sleeve 92 and the magazine 3 without forming any obstacle to the longitudinal sliding motion of this magazine 3 with respect to the solidly joined assembly formed by the sleeve 92 and the supporting frame 46. The ring 100 may be made of synthetic rubber for example.

In the zone 97, the inner peripheral face 98 of the sleeve 92 is joined by a transversal, ring-shaped plane shoulder 101, pointed frontwards with respect to the direction 17, to an inner peripheral face 102 which also has a cylindrical shape of rotation on the axis 1 and pointed towards this axis 1, but has a diameter which is slightly smaller than that of the inner peripheral face 98. This diameter of the face 102 is, however, at least equal to the greatest diameter of the magazine 3 with reference to the axis 1, at least in a rear zone with reference to the direction 17, i.e., in practice, this diameter of the face 102 is at least equal to the greatest diameter of the plate 38 in the example illustrated or, in other words, to the diameter of a face 104, with a cylindrical shape of rotation on the axis 1, demarcating the plate 38 in the direction away from this axis in the illustrated example. Advantageously, the respective diameters of the faces 102 and 104 are substantially identical to permit mutual contact with guidance in the relative, longitudinal sliding motion. In the position shown in the figures, however, there is no contact between the face 102 and the face 104, the former being offset frontwards with respect to the latter.

Along the axis 1, in a frontward longitudinal projection with reference to the direction 17, the back piece 95 has a ring-shaped skirt 105, borne in a solidly joined way, on its face 103. This ring-shaped skirt 105 has a shape of rotation on the axis 1 and has, notably in the direction away from and towards this axis, internal and external peripheral faces, 106 and 107 respectively, both having a cylindrical shape of rotation on this axis 1. The diameter of the face 106, which extends from the face 103 to a transversal edge 108 providing connection with the face 107, located at an longitudinal level which is intermediate between that of the plate 38 closing the weapon tubes 4, 5, 6, 7, 8, 9, towards the rear and that of the junction between the tail unit such as 42 of the rockets such as 40 and the motor such as 45 of these rockets, is chosen so as to be slightly smaller than the diameter of an inner peripheral face 109 which the central tube 16 has towards the axis 1, with a cylindrical shape of rotation on this axis. The face 107, for its part, extends towards the rear from the transversal ring-shaped 108 up to a longitudinal level approximately corresponding to that of the plate 38. This is the level at which the face 107 is joined by a transversal ring-shaped shoulder 110 to a face 111 which also has a cylindrical shape of rotation on the axis 1 with a diameter which is smaller than that of the face 107 to which this face 111 is pointed. This face 111 itself extends backwards, from the shoulder 110, up to a plane transversal end face 112 located approximately at mid-distance between the shoulder 110 and the face 103 of the back piece 95. This face 112 is ring-shaped and is joined, towards the axis 1, to a longitudinal bore 113 that goes through the back piece 95, from one side to the other, along the axis 1.

This bore 113 receives, with imperviousness, a rectilinear rod 114 which is solidly joined to the back piece 95. This rectilinear rod 114 is bounded, away from the axis 1, by an external peripheral face 115 with a cylindrical shape of rotation on this axis and with a diameter which is smaller than that of the face 111. Towards the front with reference to the direction 17, starting from the face 112, the rod 114 has a longitudinal dimension which is substantially equal to twice the distance between the face 112 and the ring-shaped edge 108 of the skirt 105, i.e. it extends like this skirt 105 into the central tube 16 of the magazine 3 but does so along a length which is approximately twice that of the skirt 105. In a front end zone, the rod 115 has a solidly joined transversal head 116 which is also located approximately in the rear quarter of the longitudinal dimension of the tube 16. In a direction away from the axis 1, the head 116 is bounded by an external peripheral face 117, with a cylindrical shape of rotation on the axis 1, with a diameter which is intermediate between the respective diameters of the faces 115 and 109. Towards the front, it is bounded by a transversal face 118 of any shape whereas towards the rear, between the faces 115 and 117 it is bounded by a transversal, plane, ring-shaped face 119 pointing towards the edge 108 and lined with a transversal washer 120 made of a shock-absorbing material such as synthetic rubber. It will be noted that the head 116 does not form any obstacle to the longitudinal sliding of the magazine 3 with respect to the barrel 2.

The head 116, provided with the washer 120, forms a frontward stop block for a piston 121 which is mounted to slide longitudinally within the sleeve 92 and shall now be described.

The piston 121 is made up of two parts forming a rigid, solidly joined unit capable of sliding longitudinally both with respect to the face 106 of the skirt 105 of the back piece 95 of the sleeve 92 and with respect to the inner peripheral face 109 of the central tube 16 of the magazine 3.

To this effect, the piston 121 has a first part 122 which is tube-shaped and longitudinal, and is essentially housed in the tube 16 and is bounded, respectively in the directions away from and towards the axis 1 by faces with cylindrical shapes of rotation on this axis 1, namely an external peripheral face 123 with a diameter that is substantially identical to that of the face 109 of the tube 16 with which it is in sliding contact and an inner peripheral face 124 with a diameter which is substantially identical to that of the external peripheral face 106 of the skirt 105 with which this face 124 is also in sliding contact so much so that the first part 122 of the piston 121 and the skirt 105 work together like a slide bar and a sliding channel, respectively, to guide the rear end of the magazine 3 in the longitudinal sliding motion with respect to the barrel 2. Immediately behind the washer 120 of the stop head 116, with reference to the direction 17, and in contact with this washer 120, the first part 122 of the piston 121 is closed on the face 115 of the rod 114 by a plug 324 forming a transversal collar which has, along the axis 1, a bore 125 with a cylindrical shape of rotation on this axis and having a diameter which is substantially identical to that of the face 115 of the rod 114 so as to enable a mutual guiding contact in the relative, longitudinal sliding motion. Frontwards, with respect to the direction 17, the plug 324 has, around the bore 125, a ring-shaped, plane, transversal face 126 around the bore 125 in contact with the washer 120 in the position shown whereas, towards the rear with reference to the direction 17, i.e. in front of the face 112 of the back piece 95, it has a ring-shaped, plane, transversal face 127 provided with a backward projecting, ring-shaped shoulder 128 around the bore 125. A helical spring 129 which is wound around the rod 115 rests respectively frontwards on the plug 324 and backwards on the back piece 95, longitudinally, through the face 127, between the edge 128 and the face 124, and through the face 112. This helical spring 129 thus exerts force elastically on the plug 324 and, with it, on the entire piston 121, frontwards with respect to the direction 17, to press the face 126 of the plug 324 against the washer 120 of the stop head 116. A movement of the piston 121 and more particularly, of the plug 324 towards the rear is nevertheless possible through an increase in the longitudinal compression of the spring 129.

Towards the rear with respect to the direction 17, the faces 123 and 124 of the first part 122 of the piston 121 extend up to a transversal, ring-shaped shoulder 329 of the first part 122 of the piston 121. This shoulder 329 forms a projection away from the axis 1 on the external peripheral face 123, at an intermediate longitudinal level between the respective levels of the shoulder 101 linking the internal peripheral faces 98 and 102 of the sleeve 92 and the face 103 of the back piece 95 while, at the same time, being further away from the face 103 than from the shoulder 101 in the position shown in the figures. Immediately facing the shoulder 329, longitudinally, the face 103 has a transversal, ring-shaped washer 130 made of an elastically compressible material such as a synthetic rubber, from which the shoulder 329 moves away frontwards, with reference to the direction 17, in the position shown in the figures but this washer 130 is capable of damping a longitudinal motion of the shoulder 329 and of the entire piston 121 towards the face 103 when the shoulder 329 reaches the immediate vicinity of this face 103 during a motion of this type.

Through the shoulder 329, the first part 122 of the piston 121 is joined with the second part 131 of the latter. The second part 131 is ring-shaped, flat and transversal with a general shape of rotation on the axis 1. Towards the axis 1, the part 131 of the piston 121 is bounded by a face 132 with a cylindrical shape of rotation on this axis and with a diameter which is substantially equal to that of the face 123 of the first tubular part 122, in such a way that the face 132 matches a zone of the face 123 which is immediately adjacent to the shoulder 329. In a direction away from the axis 1, the second part 131 of the piston 121 is bounded by a face 133 which also has a cylindrical shape of rotation on the axis 1 but has a diameter which is substantially identical to that of the inner peripheral face 102 of the sleeve 92 so as to set up, with this face 102, a guiding contact for the relative longitudinal sliding motion, with imperviousness being achieved by means of an O-ring 134 housed in a ring-shaped groove of the face 133. It will be seen that, in the position shown in the figures, the face 133 overlaps the shoulder 101 which joins the two inner peripheral faces 92 and 102 of the sleeve 92 to each other, the O-ring 134 being nevertheless placed in a zone of the face 133 in contact with the face 102. Towards the rear, seen along the direction 17, the piston 121 has a transversal, plane, ring-shaped face 135 in the immediate vicinity of the face 133. This face 135 is coplanar with a face 136, also transversal, plane and ring-shaped, bounding the shoulder 329 towards the rear. This face 135 of the second part 131 of the piston 121 is joined to the shoulder 329 of the first part 122 by a concave, ring-shaped face 137 in such a way that the coplanar faces 135 and 136 together define the zones of the piston 121 which are closest to the face 103 of the back piece 95 of the sleeve 92. However, at least one rectilinear, longitudinal rod 138, solidly joined to the second part 131 of the piston 121 at the hollow face 137 of this piston, forms a projection backwards with respect to the faces 135 and 136, so as to get engaged in blind hole 139, in a relationship of guidance in the relative sliding motion parallel to the axis 1, without any possibility of relative rotation on this axis. This blind hole 139 is made coaxially in the back piece 95 of the sleeve 92. The cooperation between the rod 138 and the blind hole 139 makes it possible to index the piston 121 irrespectively of the position of this piston between the position shown and a position in which it is applied by the face 136 against the washer 132, when the latter is totally compressed, by its face 135 on the face 103 of the back piece 95.

Towards the front, from its inner perpheral face 132 to its outer peripheral face 133, the second part 131 of the piston 121 is bounded by a transversal, plane, ring-shaped face 140 with which, in the position shown, the ring-shaped plate 38 of the magazine 3 is in contact by a transversal, plane, ring-shaped face 141 which, for its part, points backwards and joins the outer peripheral face 104 of the ring-shaped plate 38 to an inner peripheral face 142 of this ring-shaped plate 38. This face 142 has a cylindrical shape of rotation on the axis 1, with a diameter identical to that of the face 109 of the central tube 16, so as to extend this face 109 backwards, without any obvious discontinuity, and so as to be like the face 109, in sliding contact with the face 123 of the part 122 of the piston 121.

To enable the transmission of electrical signals for the firing of the ejection charges such as 44 from the electrical control box 56 when the trigger 61 is actuated, a flexible electrical wire 143 connects the box 56, in passing by the immediate vicinity of the back piece 95, to an electrical connector 144 housed in the second part 131 of the piston 121 and leading frontwards, by the face 140 of this piston 121, to cooperate, in the position shown, with a complementary connector 145 placed so as to immediately face it, with reference to the longitudinal direction, in the ring-shaped plate 38 from which this connector 145 emerges through the face 141. The two connectors 144 and 145 have complementary shapes such that they provide for mutual electrical connection when the faces 140 and 141 approach each other longitudinally up until they make mutual contact, and so as to break this electrical connection through a relative, longitudinal moving away of the faces 140 and 141. For example, the connectors 144 and 145 consist of plugs or sockets, male and female respectively, which can be plugged together by relative longitudinal movement.

The connector 145 of the ring-shaped plate 38 is itself connected by cables 146, housed in a system of channels 147 made in the plate 38 which, in the example shown, is made of two parts to this effect, as well as in the three plugs such as 39 respectively corresponding to the weapon tubes 4, 6 and 8, namely every other tube, to a respective, electrical igniting device such as 147 (in the case of the plug 39) which is itself in contact towards the front with the pyrotechnical ejection charge such as 44, associated with the same plug such as 39, found by a powder charge. In a manner which is not illustrated but can be easily deduced from the shape, as shown, of the plug 39, the three plugs respectively corresponding to the tubes 5, 7 and 9 have no electrical igniting device 147 but nevertheless enclose an ejection powder charge identical to the charge 44, said ejection powder charge being connected to the ejection powder charge of the plug corresponding to a diametrically opposite weapon tube, with reference to the axis 1, by means of a fire transmission channel. Thus, the ejection powder charge 44 of the plug 39 corresponding to the weapon tube 4 is connected, by a fire transmission channel 148, to the identical charge of the plug corresponding to the weapon tube 7 diametrically opposite to the weapon tube 4 with reference to the axis 1. The ejection powder charge, identical to the charge 44, of the plug corresponding to the weapon tube 6 is connected by a fire transmission channel 149 to the identical charge of the plug of the weapon tube 9. And the ejection powder charge, identical to the charge 44, of the plug corresponding to the weapon tube 8 is connected by a fire transmission channel 150 to the identical charge fitted into the plug of the weapon tube 5. The three fire transmission channels 148, 149, 150 are independent of one another.

Under these conditions, the weapon that has just been described works as follows:

In the state of the weapon shown in the figures, the magazine 3, the six weapon tubes 4, 5, 6, 7, 8, 9 of which contain a rocket such as 40 and the connector 145 of which is electrically connected with the connector 144 of the piston 121, with mutual contact of the faces 140 and 141, occupies an extreme front position with respect to the barrel 2, wherein the plug 324, upon which force is exerted by the spring 190, is stopped frontwards on the head 116 through the washer 120, and wherein the slide bar 76, solidly joined with the slide bar 72, with respect to a longitudinal movement, rests on the wall 83 of the sliding channel 77 by means of the plate 151 made of elastically compressible material.

When the trigger 61 is pressed after the electrical firing control means of the box 56 have been put into operation by means of the switch 62, the electrical control means housed in the box 56, made for this purpose in a manner that can be easily defined by those skilled in the art, transmit, through the cables 143, the connectors 144 and 145 and the cable 146, an electrical signal or command for the ignition of one specified unit of the rocket ejection charge firing devices with which the plugs such as 39 are fitted. For example, the ignition device 147 fitted to the plug 39 is thus excited when the trigger 61 is first actuated after the positioning of a magazine 3, with its six weapon tubes 4, 5, 6, 7, 8, 9 containing a rocket such as 40. This causes the corresponding ejection charge 44 to be ignited. This ignition causes a major quantity of gas to be quickly released. This gas, at the same time, collects in the volume 43 bounded by the piston 200 housed in the tail unit 42 of the corresponding rocket 40 and thus initiates the motor 45 of this rocket and, through the channel 148, reaches the plug corresponding to the weapon tube 7 diametrically opposite to the weapon tube 4, with respect to the axis 1, to initiate the rocket ejection charge corresponding to this tube 7 and to also cause a great quantity of gas to be emitted in this tube. This gas gathers in the volume similar to the volume 43 of the piston similar to the piston 200, interposed between the rocket in the tube 7 and the plug, similar to the plug 39, in this tube 7. It will be noted that this method of igniting the ejection charges corresponding to the two diametrically opposite tubes 4 and 7 causes a slight delay in the ignition of the ejection charge corresponding to the tube 7 with respect to the ejection charge 44 corresponding to the tube 4. The result thereof is a delay of the same order in the increase in pressure of gases from combustion of the ejection charges in the tube 7 and the tube 4 respectively. When the pressure achieved by the gases in the volume 43 reaches a value which is sufficient to apply a longitudinal thrust, along the direction 17, capable of breaking the pin 41, to the rocket 40, by means of the piston 200, this pin breaks and the rocket 40, along with the piston 200, is ejected in the direction 17 out of the tube 4, essentially under the effect of the gases released by the combustion of the charge 44 and, secondarily, under the effect of its motor 45 which will then ensure that the rocket 40 moves forward out of the weapon tube 4. With a slight delay compared with the ejection of the rocket 40, the rocket corresponding to the tube 7 is ejected from this tube with the same phenomena being repeated. The delay thus set up between the respective ejections of two rockets corresponding to the two tubes 4 and 7, diametrically opposite with respect to the axis 1, is enough to prevent these two rockets from moving forward side by side outside the weapon tubes with the risk of disturbing each other, but is weak enough to prevent any loss of aim in the weapon between two ejections. It will be seen that, in passing, the two rockets leaving the weapon tube 4 and 7 eject the respectively corresponding plugs 25 and 28 and perforate the hood 232 which advantageously has a part thinned so as to be weakened, such as 152, facing it for each of the weapon tubes such as 4.

Naturally, the thrust applied to the rockets by the gases emitted by the ejection powder charges such as 44 in the two diametrically opposite tubes 4 and 7 causes, after the pins such as 14 holding the corresponding rockets are broken, a reaction on the plugs such as 39 corresponding to these two tubes. This reaction has a longitudinal resultant in the reverse direction to that of the direction 17, along the axis 1, taking into account the fact that the two ejections take place almost simultaneously and owing to symmetry. This reaction is transmitted from the face 141 of the ring-shaped plate to the face 140 of second part 131 of the piston 121 and, therefrom, to the entire piston 121 especially to the plug 324. The magazine 3 and the piston 121 then move as a solid unit backwards, with reference to the direction 17, in being guided longitudinally firstly by the skirt 105 with which the first part 122 of the piston 121 works together and, secondly, by the sliding channel 67, with which the slide bars 72 and 73 work together. This movement is accompanied by a compression of the spring 129 which then acts as a shock absorber between the magazine 3 and the barrel 2, thus preventing violent force from being transmitted backwards, towards the gunner, with reference to the direction 17. The spring 129 is designed according to the stresses applied to the two rockets corresponding to the tubes 4 and 7 by the respectively corresponding ejection powder charges, such as 44, in such a way that this amplitude of this motion is limited to a value such that the face 135 of the piston 121 does not suddenly strike the face 103 of the back piece 95 and such that, for example, at the end of the movement, the face 136 of the shoulder 329 is applied to the washer 130 with a degree of energy that is small enough to make the washer stop the motion.

Naturally, as soon as the rockets corresponding to the tubes 4 and 7 have left these tubes, the gas pressure in the tubes 4 and 7 drops very quickly and the spring 129, over-compensating for the effects of this gas pressure, brings the piston 121 and, along with it, the magazine 123, to the position shown wherein the plug 324 rests on the head 116 by means of the washer 120.

Preferably, in a manner not shown but easily conceivable by those skilled in the art, suitably made passages set up communication among the inside of the blind hole 139, the space between the part 131 of the piston 121 and the back piece 95 of the sleeve 92, the space inside the part 122 of the piston 121 and the skirt 105 and the inside of the central tube 16 in such a way that the air can move freely from one of these spaces to the other during the movements just described, so as not to hamper these movements.

It will be noted that the recoil motion of the magazine 3 with respect to the barrel 2 is accompanied by a similar motion of the slide bar 76, driven by the slide bar 72, in the sliding channel 77. The spring 79 exerting force on the slide bar 76 frontwards is then compressed but plays only a negligible role in damping the backward motion of the magazine 3 with respect to the barrel 2 and in drawing back the magazine 3 frontwards. The spring 79 is indeed designed only according to a pull-back effect of the slide bar 76 towards the wall 83 when the magazine 3 is detached from the barrel 2.

The electrical control means integrated into the box 56 are designed in such a way that when the trigger 61 is next actuated, it is the rockets corresponding to other two weapon tubes, also diametrically opposite with respect to the axis 1, that are ejected. For example, the ignition device, similar to the ignition device 147, fitted into the weapon tube 6, is actuated thus causing the ignition of the corresponding ejection powder charge and, with a certain delay introduced by the transmission of fire through the channel 149, the ignition of the ejection powder charge corresponding to the tube 9, diametrically opposite to the tube 6. The rockets corresponding to the tubes 6 and 9 are then ejected as mentioned earlier with respect to the rockets of the tubes 4 and 7 under the same conditions and, notably, almost simultaneously but with a slight delay of the rocket of the weapon tube 9 with respect to the rocket of the weapon tube 6. The above described phenomena are reproduced identically.

Then, when the trigger 61 is again actuated, the ignition device, similar to the ignition device 147, fitted to the weapon tube 8, is actuated. This causes successive ignition of the ejection powder charges respectively corresponding to the tube 8 and the tube 5 diametrically opposite to this tube 8 with reference to the axis 1, by transmission of fire through the channel 150. The rocket of the weapon tube 8 is then ejected, immediately followed by the rocket contained in the weapon tube 5 and the above described phenomena recur identically.

The magazine 3 is then emptied of all rockets and may be removed and replaced by another similar magazine. To this effect, the button 86 is pressed thus releasing the slide bar 72 from the pawl 75, and the magazine 3 is made to slide frontwards with respect to the barrel 2 until the slide bars 72 and 73 are released from the sliding channel 67 and the rear of the magazine 3 is released from the sleeve 92. By a reverse movement, a new magazine is inserted until the pawl 75 is placed facing the blind hole 74 into which it penetrates automatically under the effect of the spring 92. This brings the entire device to the previously described state. The connection between the connector 144 of the piston 121 and the connector 145 of the new magazine 3 takes place automatically when the faces 141 and 140 come into mutual contact. Advantageously, a cam face 153, arranged at the rear of the slide bar 72 and gradually moving away from the axis 1, frontwards with respect to the direction 17, enables an automatic blanking out of the pawl 75 when the slide bar 72 is inserted into the sliding channel 67 before the pawl 75 automatically returns to the blind hole 74 when they are placed so as to face each other.

Naturally, the mode of implementation of the invention just described is purely a non-restrictive example, especially with respect to the designing and positioning of the means that guide the magazine 3 in longitudinal sliding motion with respect to the barrel 2, the means that impose a limit on the possibilities of relative, longitudinal shifting of the magazine 3 and the barrel 2, and the elastic force exerting means providing for the damping the recoil motion of the magazine 3 with respect to the barrel 2 and for the drawing back of the magazine 3 towards the rear with respect to this barrel 2. In particular, although, for reasons of simplicity, a mode of implementation has been described where these damping and pull-back functions are fulfilled by purely mechanical means, namely the spring 129 and, accessorily, the spring 79, those skilled in the art will easily understand that it will be advantageous to partially replace the spring 129, in its function of damping the recoil motion of the magazine with respect to the barrel, by hydraulic or pneumatic longitudinal damping device. Similarly, in the case of a magazine with six weapon tubes, as described, there could be provision for a different mode of controlling the ejection of the rockets corresponding to the different weapon tubes, either by providing for an automatic sequence or manual ejection sequence different from the one described, such as, for example, an ejection of the rockets one by one with automatic or manual selection of the rockets thus ejected successively or, again, an ejection of the rockets in groups of 3, with automatic or manual sequencing, or yet again ejection of all the rockets when the trigger 61 is pressed. As shown in FIG. 4A for example, automatic/manual switch 330 mounted on the control box 56 allows the gunner to choose between manual (M) or automatic (A) firing. A tube selection or sequencing switch 332, also mounted on control box 56 allows the gunner to select the number of ignition commands or signals that will be generated per trigger pull. To generate one ignition signal per trigger pull, the switch 332 is set to "1". To generate three successive ignition signals per trigger pull, the switch 332 is set to "3".

Figure 5:
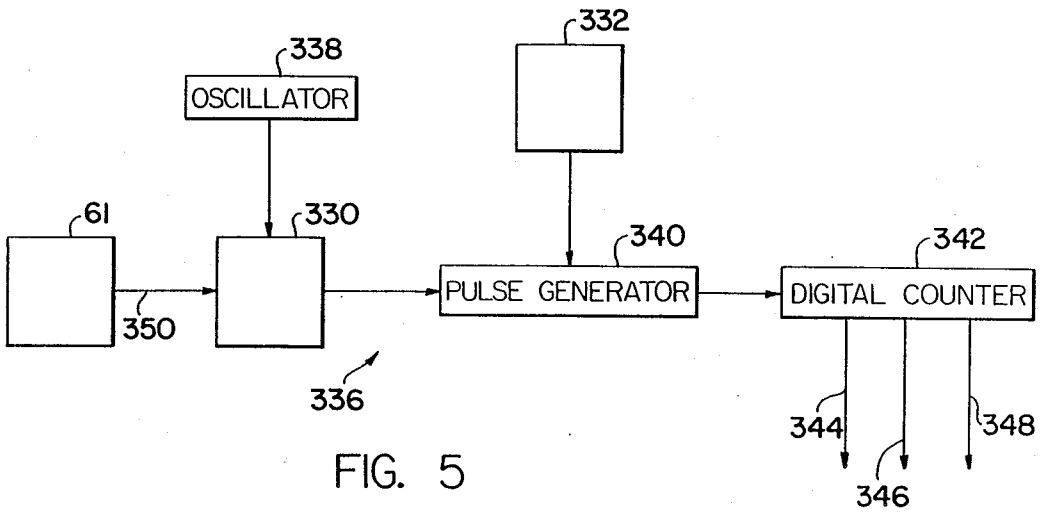
FIG. 5 is a schematic illustration of a control circuit having an automatic/manual switch and a tube sequencing switch.

FIG. 5 shows a schematic control circuit generally designated 336 for generating a single or sequence of ignition signals in response to the trigger 61 and switches 330 and 332. Control circuit 336 includes oscillator 338, pulse generator 340 and digital counter 342. A trigger signal 350 is sent continuously to sequencing switch 330 while the trigger 61 is pulled and held. The switch 330, if set to automatic, routes oscillator pulses to the pulse generator 340 while the trigger is held. If switch 330 is set to manual, only one oscillator pulse will be sent to the pulse generator 340 per trigger pull. Depending on the setting of tube selection switch 332, the pulse generator 340 sends either one, two or three clocking pulses to the digital counter 342 for each oscillator pulse received from the switch 330. Lines 344, 346 and 348 connect the digital counter 342 to the various igniters for the rockets in a magazine. Thus, counter 342 generates sequential ignition signals on the lines 344, 346 and 348 in response to clocking pulses sent by the pulse generator 340.

For example, on the first clocking pulse received by the digital counter 342, an ignition signal will be sent via line 344 to an igniter of one rocket. On the second clocking pulse, a signal will be sent to the igniter of another rocket via line 346. On the third clocking pulse, a signal will be sent via line 348 to the igniter of still another rocket. Thus if switch 330 is set to manual and tube selection switch 332 is set to "3", a pulse will be sent sequentially on each line 344, 346 and 348 each time the trigger 61 is pulled. These examples in no way restrict the scope of the invention, and the adapting of the device that has just been described to each example is within the normal abilities of those skilled in the art and in no way goes beyond the scope of the invention.

Furthermore, it is possible to provide for magazines with a different number of weapon tubes than that described above, preferably retaining the possibility of interchanging magazines with respect to one and the same barrel. Referring more specifically to the example described, wherein the barrel 2 has a control box 56 with the sequencing switch 330 set to manual (M) and the tube selection switch 332 set to "1". The control box 56 is used to selectively transmit three successive ignition commands or signals selectively to the connector 144, during three successive operations to actuate the trigger 61, there could thus be provision for the mounting, on one and the same barrel 2, of magazines comprising:

either a single weapon tube containing a single rocket ejected during the emission of the first of the ignition signals, the other two signals being ineffective;

or two weapon tubes, namely two rockets which can be ejected either simultaneously or almost simultaneously when a first ignition signal is sent, the other two ignition signals being ineffective, or at the emission of a first ignition signal and then a second ignition signal, with the third firing signal being ineffective;

or again three weapon tubes with the successive ejection of the three corresponding rockets when one of the respective ignition signals is sent out, or simultaneous or almost simultaneous ejection after the first ignition signal is sent, the other two signals then remaining ineffective;

or, yet again, a number of weapon tubes which is multiple of three with simultaneous or almost simultaneous ejection of all the rockets when the first ignition signal is sent, the other two signals remaining ineffective, or the selective, successive ejection of three groups of rockets respectively related to the transmission of the three possible ignition signals.

Naturally, depending upon the number of ignition signals that may be successively emitted by the control means housed in the box 56, when the trigger 61 is actuated, any other possibility can be chosen by those skilled in the art as regards the number of weapon tubes and as regards the order in which the respectively corresponding rockets are ejected.

What is claimed is:

1. A shoulder-borne weapon for use as a rocket launcher, having at least one longitudinal weapon tube and one barrel at least partially juxtaposed transversally with it, shoulder rest means, grip means and firing control means, wherein the weapon tube is of a type having a closed transversal end placed towards the rear with reference to a determined longitudinal firing direction, and wherein the weapon tube is connected to the barrel by means of connecting devices comprising:

means for guidance in relative, longitudinal, sliding motion, mutual stop means restricting the longitudinal sliding motion of the weapon tube at least frontwards, with respect to said direction, in relation to the barrel, and means for exerting longitudinal elastic force on the weapon tube frontwards with respect to said direction, in relation to the barrel.

2. A weapon according to claim 1, wherein the firing control means are electrical.

3. A weapon according to claim 1, wherein said closed transversal end of of the weapon tube includes a pyrotechnical charge for rocket ejection and for the initiation of rocket-propelling pyrotechnical means, said charge being capable of being ignited by the actuation of the firing control means.

4. A weapon according to any claim 1, comprising a plurality of longitudinal weapon tubes of said type, mutually juxtaposed transversally and solidly joined to one another, connected to the barrel by said connecting means, wherein the weapon tubes are distributed evenly and angularly around a longitudinal axis and wherein the elastic force exerting means have a line of effect which substantially coincides with said axis, between the weapon tubes.

5. A weapon according to claim 4, wherein the firing control means have tube selection means.

6. A weapon according to claim 5, wherein there is an even number of weapon tubes, distributed in groups of two weapon tubes which are mutually symmetrical with respect to said axis, and the tube selection means consist of means for the selection of groups of two weapon tubes which are mutually symmetrical with respect to said axis.

7. A weapon according to claim 5, wherein the selection means are automatic and sequential.

8. A weapon according to claim 1, wherein the connecting means are capable of enabling the mounting and removal of a weapon tube with respect to the barrel.

9. A weapon according to claim 8, wherein the means for guidance in relative, longitudinal sliding motion comprise means forming longitudinal sliding channels, made on the barrel, means forming slide bars, mounted to slide in the sliding channels, complementary, detachable, locking elements respectively borne by the slide bar means and by the weapon tube.

10. A weapon according to claim 9, comprising means to exert elastic force on the means forming sliding bars, frontwards with reference to said direction, in relation to the sliding channel means, and wherein the mutual stop means include means to stop the slide bar means frontwards, with reference to said direction, in relation to the sliding channel means.

11. A weapon according to claims 8, wherein the connecting means comprise a longitudinal sleeve, solidly joined to the barrel, located in a rear zone of the barrel with reference to said direction and receiving the weapon tube in longitudinal sliding motion, and wherein the means exerting elastic force on the weapon tube, frontwards with reference to said direction, in relation to the barrel, include a piston which is mounted so that it slides longitudinally in the sleeve and on which the weapon tube rests, towards the rear with reference to said direction, by said transversal end, means exerting elastic force on the piston frontwards with reference to said direction, in relation to the sleeve, and means to stop the piston frontwards with reference to said direction, in relation to the sleeve.

12. A weapon according to claim 11, wherein the firing control means are electrical, said closed, transversal end, the piston and the weapon tube include, in respective positions facing one another longitudinally, complementary means for the electrical connection of the firing control means.

13. A weapon according to claim 11, having a plurality of longitudinal weapon tubes of said type, mutually juxtaposed transversely and solidly joined to one another and connected to the barrel by said connecting means, wherein the weapon tubes are distributed evenly and angularly around a longitudinal axis and wherein the elastic force exerting means have a line of effect which substantially coincides with said axis, between the weapon tubes, wherein the weapon tubes mutually demarcate, along said axis, a longitudinal housing, wherein the piston has, solidly joined along said axis, a tubular extension frontwards, with respect to said direction, inside said housing, wherein the sleeve bears, towards the rear of the piston, with reference to said direction a solidly joined transversal back piece carrying a solidly joined rod that projects frontwards, with respect to said direction, along said axis, said rod crossing said tubular extension from one side to the other, and having a solidly joined transversal stop head within said housing, in front of said tubular extension with reference to said direction, and wherein said tubular extension bears, solidly joined between said transversal back piece and said stop head, a collar mounted so that it slides longitudinally on the rod and respectively rests, frontwards and towards the rear, with reference to said direction, against said stop head and against a helical spring with longitudinal compression, which is housed between said rod and said tubular extension and itself rests on said back piece towards the rear, with reference to said direction.

14. A weapon according to claim 13, wherein said transversal back piece carries, solidly joined, around said rod and said spring, within said tubular extension, a longitudinal skirt for its guidance in longitudinal sliding motion.

* * * * *